United States Patent [19]

Stoll

[11] Patent Number: 4,848,107

[45] Date of Patent: Jul. 18, 1989

[54] BATCH WASHING MACHINE

[75] Inventor: Karl-Heinz A. Stoll, Wiesbaden, Fed. Rep. of Germany

[73] Assignee: Senkingwerk GmbH, Hildesheim, Fed. Rep. of Germany

[21] Appl. No.: 159,119

[22] Filed: Feb. 23, 1988

[30] Foreign Application Priority Data

Mar. 21, 1987 [DE] Fed. Rep. of Germany ..... 3709332

[51] Int. Cl.[4] ..... D06F 21/07

[52] U.S. Cl. ..... 68/27; 68/58; 68/143; 68/145

[58] Field of Search ..... 68/27, 143, 145, 58; 8/159

[56] References Cited

U.S. PATENT DOCUMENTS 4,020,659 5/1977 Bhavsar ..... 68/27
4,034,583 7/1977 Miesslar ..... 68/143 X
4,422,309 12/1983 Schmidt et al. ..... 68/58 X
4,494,265 1/1985 Schmidt et al. ..... 68/58 X
4,518,500 5/1985 Viera ..... 68/143 X

FOREIGN PATENT DOCUMENTS 3040309 5/1982 Fed. Rep. of Germany ..... 68/43
2007602 7/1981 United Kingdom ..... 68/27

*Primary Examiner*—Frankie L. Stinson
*Attorney, Agent, or Firm*—Herbert Dubno

[57] ABSTRACT

In a batch washing machine which is divided by a screw conveyor into a plurality of wash chambers (I. . .IV) a bath level reduction can be provided in the final wash chamber by perforating the screw conveyor (and/or the wash trommel) in a region overlapping the reversing angle of 300° for the wash motion of the wash trommel. One rotates the wash trommel as the need requires in the vicinity of the perforations. Water can escape in the desired amount in the final chamber in the sector with the perforations according to the extent of the rotation.

3 Claims, 2 Drawing Sheets

BATCH WASHING MACHINE

FIELD OF THE INVENTION

My present invention relates to a washing machine and, more particularly, to a batch washing machine.

BACKGROUND OF THE INVENTION

A batch washing machine can comprise a tubular wash trommel or drum which is divided into individual wash chambers, more particularly containing a screw or worm conveyor which forms the individual wash chambers. The individual wash process is performed by reversing partial rotations of the wash trommel and the transport of a batch of wash into the next one of the wash chambers occurs by more than one complete rotation of the wash trommel.

In German Utility Pat. No. 1 894 718 a batch washing machine is described. The individual batches of wash are fed in at one end of the wash trommel and discharged from the other end. According to the pitch of the screw conveyor a wash chamber is formed for each of the batches of wash. The individual wash process is performed by reversing rotary motion of the wash rommel of less than 360°, advantageously of about 300°, while the transport of the batches of wash into the following chamber is effected through more than a complete rotation of the trommel in the same direction.

The individual chambers form a prewash zone, a clear wash zone and a rinsing zone in which different modes of action to supply and remove water, washing means and chemicals are provided to perform the optimum wash process. It is necessary to provide the corresponding chambers with an outer trommel (German Pat. No. 30 40 309) at considerable expense or effort.

Frequently it is necessary to reduce the water flow in the final chamber of the rinsing zone which is simultaneously the last chamber of the entire machine. This is the case when a starching is required in this chamber or when other expensive chemicals such as finishing chemicals must be provided. The water level commonly used in rinsing is then much too high to attain a satisfactory result with an economical use of the starching, softening or finishing chemicals.

It is thus desirable to reduce the water level from say 6 liter/kg dry wash to only 3 liter/kg dry wash. It is also necessary to completely remove the water when the rinsing process is again repeated in the same chamber.

OBJECTS OF THE INVENTION

It is an object of my invention to provide an improved batch washing machine which will obviate these drawbacks.

It is also an object of my invention to provide an improved batch washing machine with a screw conveyor in which it is possible to reduce the bath level in the final chamber with simple means.

SUMMARY OF THE INVENTION

These objects and others which will become more readily apparent hereinafter are attained in accordance with my invention in a batch washing machine comprising a tubular wash trommel which is divided into individual wash chambers, particularly containing a wormlike screw conveyor forming the individual wash chambers. The wash process is performed by reversing partial rotation of the wash trommel and the transport of a batch of wash into the next wash chamber is effected by more than one complete rotation of the wash trommel.

According to my invention a wall of the screw conveyor closing the final wash chamber and/or the wash trommel is perforated in a region which extends beyond the reversing angle and lies below the liquid level when the reversing angle displacement is exceeded.

Because of the perforations in the final chamber the wash trommel during the normal working cycle can be rotated back and forth only so far that the perforated portion does not come into contact with the wash.

When the batch of wash in the final chamber is to be freed from a part of the wash solution, the machine is driven so that the batch of wsh lies in front of the perforated portion of the screw conveyor and/or the trommel surface (i.e. the perforated portion lies below the level of water of the batch) so that water can escape.

After the required time the batch can either be washed again or further or removed. This is accomplished simply by suitable control of the wash trommel motion.

In one advantageous example of my invention shortly before an end of the screw conveyor the screw conveyor is perforated in a region comprising approximately a sector of from 60° to 70° C. Advantageously the shell of the wash trommel can be perforated in the vicinity of the discharge end of the screw conveyor.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
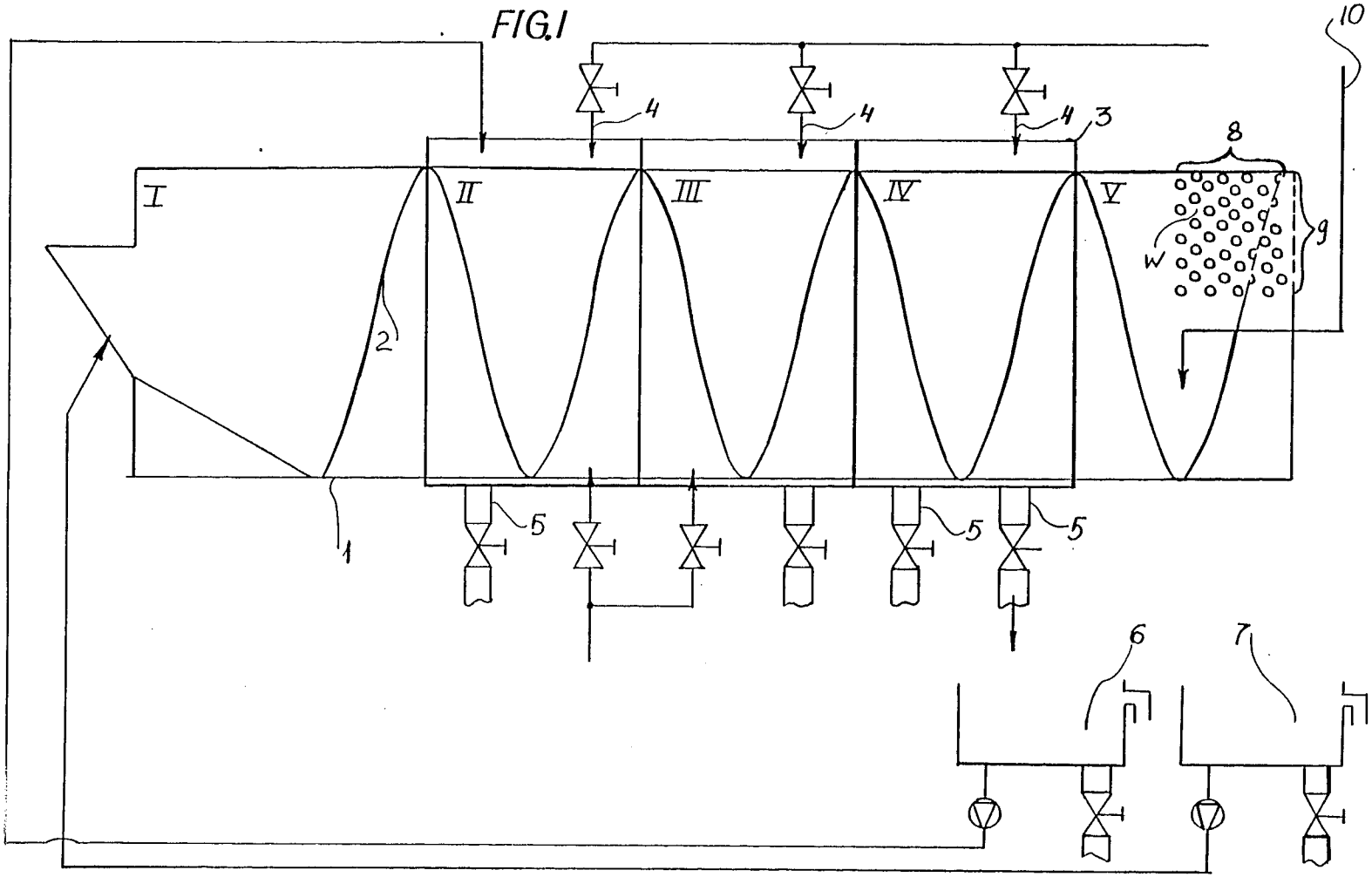
FIG. 1 is a cross sectional view through a batch washing machine according to my invention.

The wash trommel 1 comprising a substantially horizontal tube 1 is divided into a plurality of individual wash chambers I to V and of course advantageously by a wormlike screw conveyor 2. Thus a prewash zone (I), clear wash zones (II and III) and rinse zones (IV and V) result. To undertake a bath change in the clear wash zones (II and III) as well as in the rinsing zone IV the wash trommel 1 is surrounded there by an additional trommel shell 3 spaced from it which is similarly divided into chambers and is provided with feed pipes 4 for fresh water or chemicals as well as discharge pipes 5 for wash liquor (see the commonly owned U.S. Pat. Nos. 4,607,509; 4,616,372; 4,694,665).

Also it is possible to collect the rinse water from the rinsing chambers IV and/or V in the intermediate containers 6 and 7 and if necessary to feed it back into one of the upstream or front chambers for further use as is indicated in FIG. 1.

The final chamber V (rinsing chamber) is not surrounded by the trommel shell 3 and a bath level control can be undertaken also in this chamber.

The screw conveyor 2 and/or the wash trommel 1 to that end has a plurality of corresponding perforations 8 and/or 9 overlapping the reversing angle. It is sufficient for bath level regulation with the perforations to proceed until under the normal bath level to allow a portion of the liquor to flow away to continue the wash process again. This is substantially simpler than providing the chamber V similarly with an additional shell as well as with an inlet and an outlet connector. The rinsing water and any necessary chemicals can be fed centrally through the pipe 10 to the chamber V.

Figure 2:
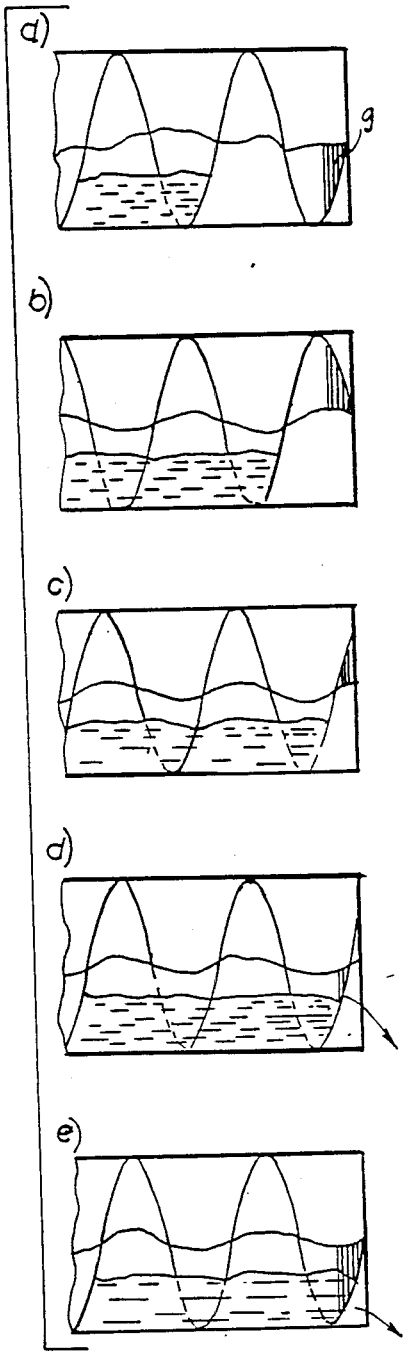
FIGS. 2 and 3 are respective series of action views with reverse motion and bath level control.
Figure 3:
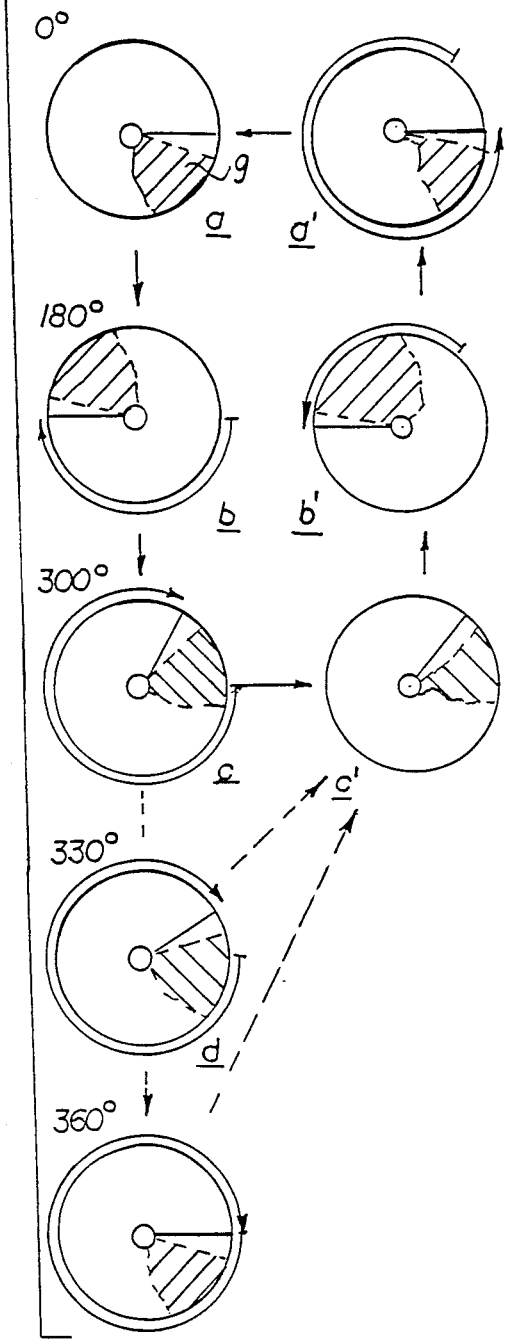

FIGS. 2 and 3 diagram the operation. FIG. 2 consists of diagrammatic longitudinal cross sections through the wash trommel and FIG. 3 represents diagrammatic views of the outlet of the washing machine. The individual diagrams show the following:

(a) The finished washed final batch of wash is just being discharged and the wash trommel is returned to the initial position (0°). The final chamber is empty and the next batch of wash is advanced and treated by repeated reversing rotation of the wash trommel by the stations (b) 180° in forward direction (c) 300° in the forward direction (b) 180° in the back direction (a) in the initial position.

When the treatment in the final chamber should occur with a reduced bath level, the action is not reversed again subsequent to step (c) but the drum is rotated beyond the 300° position so that the batch of wash reaches the region with the perforations 9 of the screw conveyor 2 and/or the wash trommel 1 (step d in FIGS. 2 and 3). Thus an overflow for the wash liquor can occur. According to the rotation angle, e.g. 330° in diagram (d) or 360° in diagram (e) a variably large amount of wash liquor can flow away and thus the desired bath lever can be adjusted. Subsequently an additional treatment can be undertaken by return to the conventional reversing cycle (c), b, a, b, c, as represented by lines 20, 21.

With the reduced bath level especially a retreatment of the wash such as a strengthening or finishing is performed to make good conditions of water flow for flow of the treatment means. The entire rinsing water flow can be replaced when the wash liquor is completely removed and fresh water is fed in by the pipe 10.

By "final" chamber I mean the wash chamber furthest downstream.

The additional displacement during the reversible rotation or angular displacement of the trommel for draining the final zone can be obtained by proper programming of the programmed controller for the trommel (see the aforementioned U.S. patents).

I claim:

1. A batch washing maching comprising:

an elongated tubular wash trommel having a longitudinal axis, an upstream end and a downstream end;

a coil like screw conveyor in said trommel subdividing said trommel internally into a plurality of individual wash chambers thereby forming a last chamber at said downstream end of said trommel, said coil like screw conveyor having a conveying surface rotatable about said longitudinal axis in said trommel, said conveying surface having a respective turn in each of said chambers whereby, upon angular oscillation of said surface through a reversing angle less than 360°, batches of laundry in each chamber are angularly oscillated and, upon a rotation of said surface through more than 360°, said batches are advanced from one chamber to the next until each batch arrives at said last chamber, said downstream end of said trommel being formed with perforations in a region beyond said reversing angle so that said perforations upon the rotation of the trommel beyond the reversing angle selectively drain at least some of the wash liquor from said final compartment and limit the quantity of wash fluid in said last chamber.

2. The batch washing machine defined in claim 1 wherein said region comprising approximately a sector of from 60° to 70°.

3. The batch washing machine defined in claim 1 wherein a shell of said wash trommel is perforated in the vicinity of the outlet of said screw conveyor.

* * * * *